United States Patent [19]

Mims et al.

[11] Patent Number: 4,850,429

[45] Date of Patent: Jul. 25, 1989

[54] RECOVERING HYDROCARBONS WITH A TRIANGULAR HORIZONTAL WELL PATTERN

[75] Inventors: Donald S. Mims; Wann-Sheng Huang; Stewart Haynes, all of Houston, Tex.

[73] Assignee: Texaco Inc., White Plains, N.Y.

[21] Appl. No.: 135,199

[22] Filed: Dec. 21, 1987

[51] Int. Cl.[4] ..... E21B 43/24; E21B 43/30

[52] U.S. Cl. ..... 166/245; 166/50; 166/263; 166/272

[58] Field of Search ..... 166/50, 245, 263, 272

[56] References Cited

U.S. PATENT DOCUMENTS

| | | | |
|---|---|---|---|
| 2,365,591 | 12/1944 | Ranney | 166/263 X |
| 4,130,163 | 12/1978 | Bombardieri | 166/263 X |
| 4,227,743 | 10/1980 | Ruzin et al. | 166/253 X |
| 4,249,604 | 2/1981 | Frazier | 166/263 |
| 4,410,216 | 10/1983 | Allen | 166/263 X |
| 4,495,994 | 1/1985 | Brown et al. | 166/263 X |
| 4,577,691 | 3/1986 | Huang et al. | 166/263 |
| 4,598,770 | 7/1986 | Shu et al. | 166/50 X |
| 4,637,461 | 1/1987 | Hight | 166/263 X |
| 4,700,779 | 10/1987 | Huang et al. | 166/263 |
| 4,706,751 | 11/1987 | Gondouin | 166/263 X |

*Primary Examiner*—George A. Suchfield

*Attorney, Agent, or Firm*—Jack H. Park; Kenneth R. Priem; Harold J. Delhommer

[57] ABSTRACT

The invention is a method of recovering hydrocarbons from an underground hydrocarbon formation which comprises drilling and completing at least three substantially parallel horizontal wells to form a substantially triangular well pattern within a hydrocarbon formation. The first well is placed relatively near the top of a hydrocarbon interval and the second and third wells are placed near the bottom of the interval on each side of the first well. A recovery fluid is injected into the formation through the second and third wells and hydrocarbons and other fluids are recovered through the first well.

5 Claims, 1 Drawing Sheet

RECOVERING HYDROCARBONS WITH A TRIANGULAR HORIZONTAL WELL PATTERN

BACKGROUND OF THE INVENTION

This invention concerns the recovery of hydrocarbons from an underground formation by the use of horizontal injection and production wells. More particularly, the invention employs horizontal production and injection wells arranged in a substantially triangular pattern with certain injection and production steps.

Horizontal wells have been investigated and tested for oil recovery for quite some time. Although horizontal wells may in the future be proven economically successful to recover petroleum from many types of formations, at present, the use of horizontal wells is usually limited to formations containing high viscous crude. It seems likely that horizontal wells will soon become a chief method of producing tar sand formations and other highly viscous oils which cannot be efficiently produced by conventional methods because of their high viscosity. Most heavy oil and tar sand formations cannot be economically produced by surface mining techniques because of their formation depth.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

A system of using parallel horizontal wells drilled laterally from subsurface tunnels into the lower portion of a tar sand formation is disclosed in U.S. Pat. No. 4,463,988. The described process injects a displacing means such as steam into the boreholes to cause hydrocarbons to flow into the lower portion of the lateral borehole and be produced to the surface.

U.S. Pat. No. 4,577,691 discloses a plurality of parallel horizontal wells arranged in a vertical plane whereby a thermal fluid can be injected into upper wells to drive hydrocarbons down from the area of the upper wells to the horizontal wells immediately below and lying in the same vertical plane. U.S. Pat. No. 4,700,779 discloses a pattern of four or more horizontal wells lying parallel to each other in a horizontal plane within a thin reservoir. The wells in a horizontal plane are used with a combination steam and water injection process to sweep oil from one end to the other end of the pattern.

The use of two or more parallel horizontal injection and production wells is disclosed in U.S. Pat. No. 4,598,770. In this reference, two horizontal wells are drilled parallel to each other at the bottom of the hydrocarbon formation. A thermal fluid is injected through one of the horizontal wells and that fluid and hydrocarbons are produced at the other parallel horizontal well.

SUMMARY OF THE INVENTION

The invention is a method of recovering hydrocarbons from an underground hydrocarbon formation which comprises drilling and completing at least three substantially parallel horizontal wells to form a substantially triangular well pattern within a hydrocarbon formation. The first well is placed relatively near the top of a hydrocarbon interval and the second and third wells are placed relatively near the bottom of the interval on each side of the first well. A recovery fluid is injected into the formation through the second and third wells and hydrocarbons and other fluids are recovered through the first well.

One of the several other embodiments comprises injecting a recovery fluid into the first well and producing hydrocarbons and other fluids at the second and third wells after a selected time period of injection into the second and third wells and producing at the first well. Additional embodiments involve the use of additional wells wherein the substantially triangular well pattern is repeated. After the injection into the bottom wells and production in the top wells, steam may be injected into alternating bottom wells and produced from the remaining bottom wells. Another embodiment concerns the injection of steam into alternating bottom wells, all top horizontal wells, and production from remaining bottom wells.

BRIEF DESCRIPTION OF THE DRAWINGS

FIG. 1 is a top sectional view showing five parallel horizontal wells, and FIG. 2 is a side view along line 2—2 of FIG. 1.

DETAILED DESCRIPTION

Figure 1:
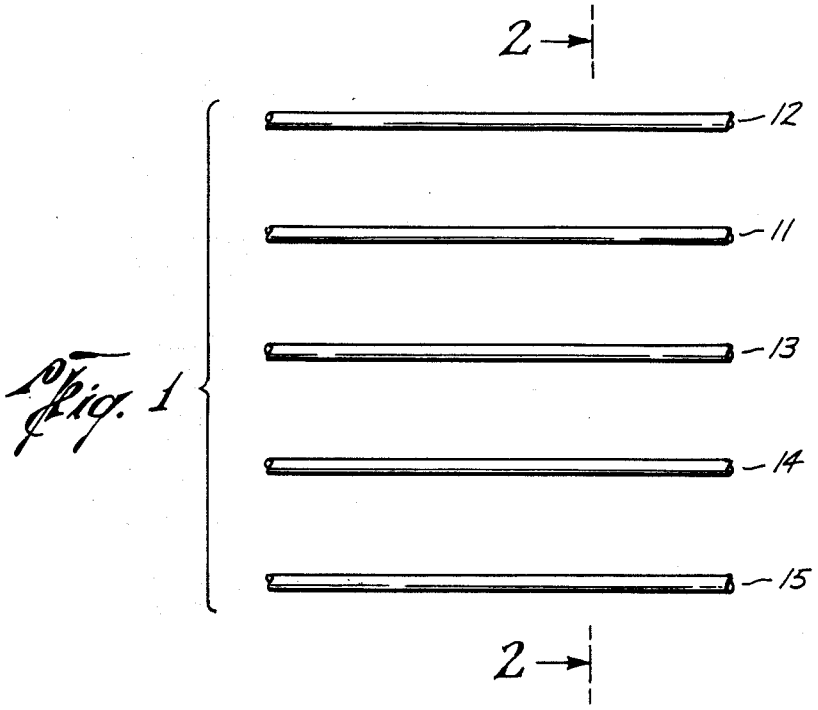
FIGS. 1 and 2 illustrate the basic triangular well pattern of the invention with parallel horizontal wells.

The invention method provides a process for recovering a substantial percentage of hydrocarbons from a formation. To practice the invention, multiple, substantially parallel wells must be drilled and completed in the underground formation to form one or more substantially triangular well patterns, with at least a portion of said wells extending through the formation in a substantially horizontal direction. Three and five horizontal wells are used in the described procedures and embodiments. It should be kept in mind that four wells, or more than five horizontal wells may be employed in the practice of the invention.

In its most basic embodiment, at least three substantially parallel horizontal wells, a first well, a second well, and a third well are drilled and completed in the formation to form a substantially triangular pattern. The first well is placed relatively near the top of the hydrocarbon interval, and the second and third wells are placed relatively near the bottom of the interval on each side of the first well. A recovery fluid is injected into the formation through the second and third wells, and hydrocarbons and other fluids are produced through the first well relatively near the top of the interval.

Preferably, a recovery fluid will be initially injected into all wells for a period of time prior to production through the first well to stimulate the wells. After a suitable period of time, the first well is converted to a producing well and injection of recovery fluid is continued at the second and third wells. The purpose of initially injecting a recovery fluid through a well and then converting the well to a production well is to lower the viscosity of viscous hydrocarbons around such a well and permit the well to become an attractive producer in the future. Another option is to cease the injection of recovery fluid through the first well, and allow the recovery fluid to soak in the formation for about 12 hours to about two weeks prior to placing the first well on production. Depending on the method of recovery, additional benefits may be obtained if recovery fluid is injected and produced at the first well or all wells in a cyclic manner until a communication path has been achieved between the first well and the second and third wells.

After injecting through the second and third wells and producing the first well for a suitable period of time, it is preferred to reverse the process and inject recovery fluid into the first well and produce hydrocarbons and other fluids at the second and third wells. Most preferably, this reversal of injection and production wells is done when production has become uneconomical at the first well.

Several other embodiments require that the substantially triangular well pattern be repeated by adding a top and a bottom well for each additional adjacent pattern. Each new triangular well pattern will contain an additional top and bottom well and a shared bottom well with the adjacent triangular pattern. The invention pattern can be employed to sweep an entire formation by repeating the substantially triangular pattern as far as desired.

To add a second adjacent triangular pattern, fourth and fifth horizontal wells are placed parallel to the first, second, and third wells such that the fourth well is placed relatively near the top of the hydrocarbon interval and the fifth well is placed relatively near the bottom of the hydrocarbon interval. The third well is located between the second and fifth wells and the fourth well is located between the third and fifth wells, although at a higher elevation. In this embodiment, a recovery fluid is injected into the three bottom wells, and hydrocarbons and other fluids are produced in the two top wells. Optionally, a recovery fluid may be initially injected into all wells prior to placing the top wells on production. It may also be desirable to reverse the injection and production schemes after a period of time and inject into the top wells and produce at the bottom wells.

Additional embodiments involve the use of alternate bottom wells. In one of these embodiments, after accomplishing the basic process of injection into the bottom wells and production from the top wells, the first and fourth top wells are shut-in. A recovery fluid is injected into alternate bottom wells, such as the second and fifth wells, while producing hydrocarbons and other fluids through the third well at the bottom. Alternately, the first and fourth top wells may be shut-in, and recovery fluid injected into the third bottom well while producing hydrocarbons and other fluids through the second and fifth bottom wells.

Depending on how successful the pattern sweeping has been, it may be desirable to employ another alternate embodiment. After injecting recovery fluid into the bottom three wells and producing at the top two wells, a recovery fluid may be injected into the first and fourth top wells and the third bottom well, and hydrocarbons and other fluids produced from the spaced apart second and fifth bottom wells. Alternately, a recovery fluid may be injected into the first and fourth top wells, and second and fifth bottom wells, and hydrocarbons and other fluids produced through the third bottom well.

Any recovery fluid known in the art of enhanced oil recovery may be employed in the invention process. Examples of possible recovery fluids are: water, water with a viscosity increasing polymer, steam, carbon dioxide, nitrogen, air, hydrocarbon solvent, or mixtures thereof. It is even possible to use two different recovery fluids in different steps of the invention process. Steam is the most preferred recovery fluid.

Figure 2:
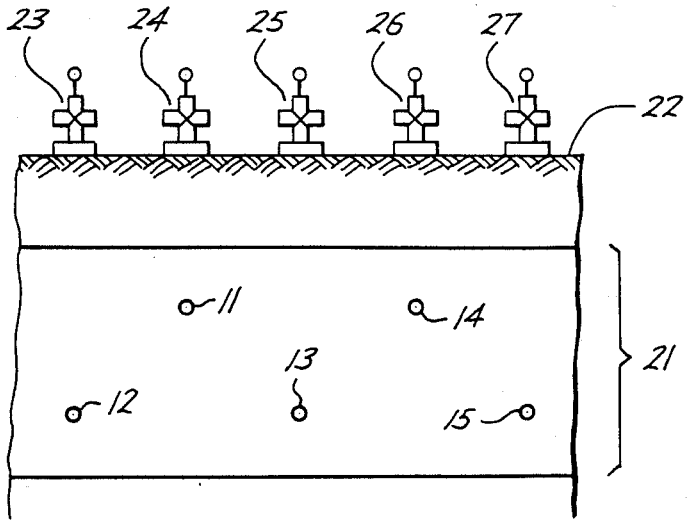

FIGS. 1 and 2 illustrate five horizontal wells which form two adjacent substantially triangular well patterns. FIG. 1 is a top sectional view illustrating the five substantially parallel horizontal wells 11, 12, 13, 14 and 15. FIG. 2 is a side view along line 2—2 of FIG. 1 showing the triangular pattern of the wells within the underground formation. Neither figure is drawn to scale.

In these views, horizontal wells 11, 12 and 13 are the first, second and third wells, respectively, forming a substantially triangular horizontal well pattern. Top well 14 and bottom well 15 are the fourth well and fifth well, respectively, which form a second adjacent triangular well pattern with shared bottom well 13. These five horizontal wells are located in a hydrocarbon producing interval 21 below ground level 22. Wellheads 23, 24, 25, 26 and 27 are illustrated above ground 22 for wells 12, 11, 13, 14 and 15, respectively. It should be appreciated that modern technology makes it possible to drill more than one of these horizontal wells from the same wellpad.

If vertical wells have been drilled into the formation, the vertical wells may be employed to supplement injection and production operations. In fact, it is possible to substitute one or more vertical wells for a horizontal well in the invention process.

The diameter and length of the horizontal wells and their perforation intervals are not critical, except that such factors will affect the well spacing and the economics of the process. Optimum well spacing may vary considerably from formation to formation and may depend upon many factors known to those skilled in the art. It is not necessary that the well spacings in a particular pattern be equal. Such decisions should be determined by conventional drilling criteria, the characteristics of the specific formation, the economics of a given situation and the well known art of drilling horizontal wells.

Such horizontal wells must extend from the surface and run a substantially horizontal distance within the hydrocarbon formation. The optimum number of horizontal wells and their distance from each other and from other vertical wells which may also be employed is a balance of economics criteria. Perforation size will be a function of other factors such as flow rate, temperatures and pressures employed in a given operation.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1.

A method of recovering hydrocarbons from an underground hydrocarbon formation, which comprises:

drilling and completing at least five substantially parallel wells, a first well, a second well, a third well, a fourth well, and a fifth well to form a pattern, said wells extending through the formation in a substantially horizontal direction, said first, second and third wells forming a first substantially triangular pattern within a hydrocarbon interval with the first well placed relatively near the top of the interval and the second and third wells placed relatively near the bottom of the interval on each side of the first well, said third, fourth, and fifth wells forming a second substantially triangular well pattern adjacent to the first substantially triangular well pattern, said fourth well placed relatively near the top of the hydrocarbon interval substantially parallel to the first well, said fifth well placed relatively near the bottom of the interval substantially parallel to the second and third well, said third well lying between the second and fifth well, and said fourth well lying between the third and fifth wells;

injecting a recovery fluid into the formation through the second, third and fifth wells;

producing hydrocarbons and other fluids through the first and fourth wells;

shutting in the first and fourth wells after producing the first and fourth wells for a period of time; and injecting a recovery fluid into the second and fifth wells while producing hydrocarbons and other fluid through the third well.

2.

A method of recovering hydrocarbons from an underground hydrocarbon formation, which comprises:

drilling and completing at least five substantially parallel wells, a first well, a second well, a third well, a fourth well, and a fifth well to form a pattern, said wells extending through the formation in a substantially horizontal direction, said first, second and third wells forming a first substantially triangular pattern within a hydrocarbon interval with the first well placed relatively near the top of the interval and the second and third wells placed relatively near the bottom of the interval on each side of the first well, said third, fourth, and fifth wells forming a second substantially triangular well pattern adjacent to the first substantially triangular well pattern, said fourth well placed relatively near the top of the hydrocarbon interval substantially parallel to the first well, said fifth well placed relatively near the bottom of the interval substantially parallel to the second and third well, said third well lying between the second and fifth well, and said fourth well lying between the third and fifth wells;

injecting a recovery fluid into the formation through the second, third and fifth wells;

producing hydrocarbons and other fluids through the first and fourth wells;

shutting-in the first and fourth wells after producing the first and fourth wells for a period of time; and injecting a recovery fluid into the third well while producing hydrocarbons and other fluids through the second and fifth wells.

3.

A method of recovering hydrocarbons from an underground hydrocarbon formation, which comprises:

drilling and completing at least five substantially parallel wells, a first well, a second well, a third well, a fourth well, and a fifth well to form a pattern, said wells extending through the formation in a substantially horizontal direction, said first, second and third wells forming a first substantially triangular pattern within a hydrocarbon interval with the first well placed relatively near the top of the interval and the second and third wells placed relatively near the bottom of the interval on each side of the first well, said third, fourth, and fifth wells forming a second substantially triangular well pattern adjacent to the first substantially triangular well pattern, said fourth well placed relatively near the top of the hydrocarbon interval substantially parallel to the first well, said fifth well placed relatively near the bottom of the interval substantially parallel to the second and third well, said third well lying between the second and fifth well, and said fourth well lying between the third and fifth wells;

injecting a recovery fluid into the formation through the second, third and fifth wells;

producing hydrocarbons and other fluids through the first and fourth wells;

injecting a recovery fluid into the first, fourth and third wells after producing the first and fourth wells for a period of time; and producing hydrocarbons and other fluids through the second and fifth wells.

4.

A method of recovering hydrocarbons from an underground hydrocarbon formation, which comprises:

drilling and completing at least five substantially parallel wells, a first well, a second well, a third well, a fourth well, and a fifth well to form a pattern, said wells extending through the formation in a substantially horizontal direction, said first, second and third wells forming a first substantially triangular pattern within a hydrocarbon interval with the first well placed relatively near the top of the interval and the second and third wells placed relatively near the bottom of the interval on each side of the first well, said third, fourth, and fifth wells forming a second substantially triangular well pattern adjacent to the first substantially triangular well pattern, said fourth well placed relatively near the top of the hydrocarbon interval substantially parallel to the first well, said fifth well placed relatively near the bottom of the interval substantially parallel to the second and third well, said third well lying between the second and fifth well, and said fourth well lying between the third and fifth wells;

injecting a recovery fluid into the formation through the second, third and fifth wells;

producing hydrocarbons and other fluids through the first and fourth wells;

injecting a recovery fluid into the first, fourth, second and fifth wells after producing the first and fourth wells for a period of time; and producing hydrocarbons and other fluids through the third well.

5. A method of recovering hydrocarbons from an underground hydrocarbon formation, which comprises:

drilling and completing at least five substantially parallel wells, a first well, a second well, a third well, a fourth well, and a fifth well to form two adjacent substantially triangular well patterns within a hydrocarbon interval with the first well and the fourth well placed relatively near the top of the interval and the second well, third well, and fifth well placed relatively near the bottom of the interval with the first well lying between the second and third wells, the fourth well lying between the third and fifth wells, and the third well lying between the second well and fifth well, said wells extending through the formation in a substantially horizontal direction;

injecting steam into all five wells for a period of time;

ceasing the injection of steam into the first and fourth wells;

continuing the injection of steam into the second well, third well, and fifth well while producing hydrocarbons and other fluids at the first well and fourth well;

shutting-in the first well and fourth well;

continuing the injection of steam into the second well and fifth well; and producing hydrocarbons and other fluids at the third well.

* * * * *